US007885591B2

(12) United States Patent
Yagi et al.

(10) Patent No.: US 7,885,591 B2
(45) Date of Patent: Feb. 8, 2011

(54) FIXING DEVICE INCLUDING A HEATING UNIT AND A PRESSURIZING UNIT THAT INCLUDES A ROTATABLE ENDLESS MEMBER AND IMAGE FORMING APPARATUS HAVING THE SAME

(75) Inventors: Masahiro Yagi, Tokyo (JP); Yoshihiro Fukuhata, Hyougo (JP); Shigeru Obata, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 885 days.

(21) Appl. No.: 11/685,946

(22) Filed: Mar. 14, 2007

(65) Prior Publication Data

US 2007/0223976 A1 Sep. 27, 2007

(30) Foreign Application Priority Data

Mar. 24, 2006 (JP) ..... 2006-083738

(51) Int. Cl.
*G03G 15/20* (2006.01)

(52) U.S. Cl. ..... 399/329; 399/328; 399/330

(58) Field of Classification Search ..... 399/328–330
See application file for complete search history.

(56) References Cited

U.S. PATENT DOCUMENTS

| | | | | |
|---|---|---|---|---|
| 5,621,512 | A * | 4/1997 | Uehara et al. | 399/328 |
| 5,666,624 | A * | 9/1997 | Kanesawa et al. | 399/329 |
| 5,960,243 | A * | 9/1999 | Daigo et al. | 399/329 |
| 2004/0131401 | A1* | 7/2004 | Nakatogawa et al. | 399/328 |
| 2006/0056887 | A1* | 3/2006 | Maeyama et al. | 399/328 |
| 2006/0083562 | A1* | 4/2006 | Matsumoto et al. | 399/329 |
| 2008/0031664 | A1 | 2/2008 | Yagi et al. | |

FOREIGN PATENT DOCUMENTS

| | | |
|---|---|---|
| JP | 2-309376 | 12/1990 |
| JP | 3298354 | 4/2002 |
| JP | 2004-258484 | 9/2004 |
| JP | 2005-77786 | 3/2005 |
| JP | 2005-115256 | 4/2005 |
| JP | 2005-164721 | 6/2005 |
| JP | 2005-208321 | 8/2005 |

* cited by examiner

*Primary Examiner*—Ryan D Walsh
(74) *Attorney, Agent, or Firm*—Oblon, Spivak, McClelland, Maier & Neustadt, L.L.P.

(57) ABSTRACT

A low-heat loss, belt nip-type fixing device achieves good recording medium separation performance without increasing the size of the device, prevents image misalignment, and achieves a high-quality image without placing a major burden on the recording medium. This fixing device comprises a heat-fixing roller having an elastic layer and a heat source; and a pressurizing unit having an elastic member with a flat surface for pressing an endless member. The endless member conveys a recording medium, against the elastic layer. A pressurizing spring biases the elastic member toward the side of the recording medium. Biasing is carried out using the pressurizing spring such that the amount of deformation of the elastic member approaches the saturation region (maximum amount of deformation) inside a region of a nip portion, which is formed between the elastic layer of the heat-fixing roller and the endless member of pressurizing unit, and through which is passed a recording medium carrying an unfixed toner image.

14 Claims, 10 Drawing Sheets

FIG. 4

| | AMOUNT OF DEFORMATION | PRESSURE | DEFORMATION RATIO | RATE OF CHANGE OF DEFORMATION RATIO (COMPARED TO INITIAL DEFORMATION RATIO) |
|---|---|---|---|---|
| POINT | % | $kgf/mm^2$ | $\%/(kgf/mm^2)$ | % |
| 81 | 15.0 | 0.01 | 1500 | 0 |
| 82 | 25.0 | 0.02 | 1000 | −33 |
| 83 | 31.0 | 0.03 | 600 | −60 |
| 84 | 35.5 | 0.04 | 450 | −70 |
| 85 | 37.0 | 0.05 | 150 | −90 |
| 86 | 38.0 | 0.06 | 100 | −93 |
| 87 | 38.5 | 0.07 | 50 | −97 |
| | | | | |
| 88 | 13.0 | 0.02 | 650 | 0 |
| 89 | 24.0 | 0.04 | 550 | −15 |
| 90 | 27.5 | 0.05 | 350 | −46 |
| 91 | 30.0 | 0.06 | 250 | −62 |
| 92 | 31.0 | 0.07 | 100 | −85 |
| | | | | |
| 93 | 13.0 | 0.04 | 325 | 0 |
| 94 | 21.0 | 0.07 | 267 | −18 |

FIG. 6

| RUBBER PERMANENT DEFORMATION OF PRESSURIZING MEMBER | IMAGE QUALITY | FIXING CHARACTERISTICS | SEPARATING CHARACTERISTICS |
|---|---|---|---|
| NO MORE THAN 5% | ○ | ○ | ○ |
| NO LESS THAN 5% | ○ | ○ | ○ |
| NO MORE THAN 5% (AFTER 100 HOURS OF IDLE HEATING) | ○ | ○ | ○ |
| NO LESS THAN 5% (AFTER 100 HOURS OF IDLE HEATING) | × | × | × |

FIG. 8

| RUBBER HARDNESS | RUBBER THICKNESS | NIP WIDTH | PRESSURE VALUE OF RATE OF CHANGE OF NO MORE THAN -30% OF RUBBER DEFORMATION RATIO | NIP WIDTH OF RATE OF CHANGE OF NO MORE THAN -50% OF RUBBER DE-FORMATION RATIO/ ENTIRE NIP WIDTH | SEPARATING CHARACTERISTICS |
|---|---|---|---|---|---|
| Hs (JIS-A) | mm | mm | $kgf/mm^2$ | % | |
| 8 | 2 | 8 | 0.025 | 63 | ○ |
| 20 | 4 | 8 | 0.042 | 13 | × |
| 30 | 4 | 8 | – | 0 | × |

FIG. 9

| HEATING ROLLER SPECIFICATIONS | SEPARATING CHARACTERISTICS |
|---|---|
| OUTSIDE DIAMETER $\phi$25 | ○ |
| OUTSIDE DIAMETER $\phi$27 | ○ |
| OUTSIDE DIAMETER $\phi$30 | × |
| RUBBER THICKNESS 1.0mm | ○ |
| RUBBER THICKNESS 0.8mm | ○ |
| RUBBER THICKNESS 0.6mm | × |
| RUBBER HARDNESS 8Hs | ○ |
| RUBBER HARDNESS 20Hs | × |
| RUBBER HARDNESS 30Hs | × |

FIXING DEVICE INCLUDING A HEATING UNIT AND A PRESSURIZING UNIT THAT INCLUDES A ROTATABLE ENDLESS MEMBER AND IMAGE FORMING APPARATUS HAVING THE SAME

BACKGROUND OF THE INVENTION

1. Field of the Invention

The present invention relates to an image forming apparatus, such as a copier, facsimile machine, and printer, and to a fixing device employed therein.

2. Description of the Related Art

To date, various devices have been proposed as fixing devices for fixing an unfixed toner image onto a recording medium. One such known device is a belt nip-type fixing device, which forms a nip portion by friction welding an endless belt to a rotatable heating roller with an elastically deformable surface, and fixing a toner image onto a recording medium by passing a recording medium carrying an unfixed toner image through this nip portion.

As an example of this type fixing device, Japanese Patent No. 3298354 proposes a fixing device comprising a pressure pad, which is arranged in a non-rotating state on the inside of an endless belt, provides a nip, which passes a recording medium through a heating roller by elastically deforming the endless belt, and locally elastically deforms the recording medium outlet side of the surface of the heating roller. In this fixing device, by locally elastically deforming the recording medium outlet side of the nip portion of the surface of the heating roller, a recording medium is separated from the heating roller at the nip portion outlet without providing separating means, such as a separating claw or the like. This takes advantage of the fact that the adhesive force of the interface between the fused toner and the heating roller surface is not determined simply by the physical property values of the chemical materials of the two surfaces alone, and is greatly affected by the deformation of the heating roller surface. Specifically, it is a phenomenon in which the adhesive force between the toner and the heating roller surface decreases when transitioning from a state in which the fused toner is making contact with the surface of the heating roller, which has surface deformation from beforehand, to a state in which this surface deformation is instantly cancelled.

In this fixing device, the recording medium outlet side of the nip portion of the heating roller surface is locally elastically deformed, and the toner is fixed onto the recording medium in the vicinity of the nip portion outlet while being subjected to deformation, and the instant this deformation is canceled at the nip outlet, a recording medium is separated from the heating roller by the abrupt drop in the adhesive force of the toner and heating roller surface. Further, this fixing device is advantageous in that, since the pressure pad is used in a non-rotating state and the endless belt is friction welded to the heating roller, heat loss is small compared to when a pressure roller is used in a rotating state.

However, the belt nip-type fixing device of the above-mentioned publication is deficient in that the recording medium outlet side of the nip portion of the heating roller surface is locally elastically deformed, and a velocity difference occurs between the front surface and rear surface of the recording medium at the part subjected to deformation by this local elastic deformation, making image misalignment more apt to occur. Further, since applying pressure to the heating roller using a hard pressure pad member creates a nip shape having a locally small curvature at the surface of the heating roller, the burden placed on the recording medium, specifically, paper damage and amount of curl, is great.

Further, in a fixing device that utilizes a heating roller, using a heating roller with a large surface curvature can enhance separation performance, but the disadvantage is that that device becomes larger in size. Using a heating roller with a small surface curvature has the advantage of compactness, but is apt to give rise to deficiencies that increase the likelihood of image misalignment, paper damage and a large amount of curl.

Technologies relating to the present invention are also disclosed in, e.g., Japanese Patent Laid-open Nos. 02-309376, 2005-077786, 2005-115256 and 2005-208321.

SUMMARY OF THE INVENTION

With the foregoing in mind, an object of the present invention is to provide a fixing device and an image forming apparatus having the same, which can achieve good recording medium separation performance without making the device larger, and can achieve high-quality images by not placing a large burden on a recording medium and preventing image misalignment, in a low-heat-loss, belt nip-type fixing device.

In an aspect of the present invention, a fixing device comprises a heating unit having an elastic portion and a heat source; and a pressurizing unit comprising a rotatable endless member for conveying a recording medium and a pressurizing member which presses the endless member against the elastic portion of the heating unit. An unfixed toner image is fixed to a recording medium by passing the recording medium, which is carrying an unfixed toner image, through a nip portion formed between the elastic portion of the heating unit and the endless member of the pressurizing device. The pressurizing member of the pressurizing device comprises an elastic member with a flat surface, and a biasing member for biasing the elastic member toward the side of the recording medium. In use of the biasing member, biasing is performed such that the amount of deformation of the elastic member approaches a saturation region (maximum amount of deformation) inside a region of the nip portion.

In another aspect of the present invention, an image forming apparatus comprises an image carrier; an electrostatic latent image forming device for forming an electrostatic latent image on the image carrier; a plurality of developing device for forming a toner image of different colors on an electrostatic latent image on the image carrier; an intermediate transfer device for transferring a toner image formed on the image carrier to an intermediate transfer member; a transfer device for transferring a toner image on the intermediate transfer member to a recording medium; and a fixing device for fixing toner, which has been transferred onto the recording medium. The fixing device comprises a heating unit having an elastic portion and a heat source; and a pressurizing unit comprising a rotatable endless member for conveying a recording medium and a pressurizing member which presses the endless member against the elastic portion of the heating unit. An unfixed toner image is fixed to a recording medium by passing the recording medium, which is carrying an unfixed toner image, through a nip portion formed between the elastic portion of the heating unit and the endless member of the pressurizing unit. The pressurizing member of the pressurizing unit comprises an elastic member with a flat surface and a biasing member for biasing the elastic member toward the side of the recording medium. In use of the biasing member, biasing is performed such that the amount of deformation of the elastic member approaches a saturation region (maximum amount of deformation) inside a region of said nip portion.

BRIEF DESCRIPTION OF THE DRAWINGS

The above and other objects, features and advantages of the present invention will become more apparent from the following detailed description taken with the accompanying drawings in which:

FIG. 4 is a table showing the relationship of the amount of deformation, pressure, deformation ratio in the load direction, and rate of change of the deformation ratio in the load direction (as compared to the initial amount of deformation) of the respective elastic members;

FIG. 6 is a table showing the results of studying initial and over-time image quality, fixing characteristics, and separating characteristics by changing the permanent deformation of the rubber in a pressurized elastic member;

FIG. 8 is a table showing test results related to separation performance;

FIG. 9 is a table showing heating roller specifications as they related to separating characteristics.

DESCRIPTION OF THE PREFERRED EMBODIMENT

An embodiment of an image forming apparatus that uses the present invention will be explained in detail below by referring to the figures.

Figure 1:
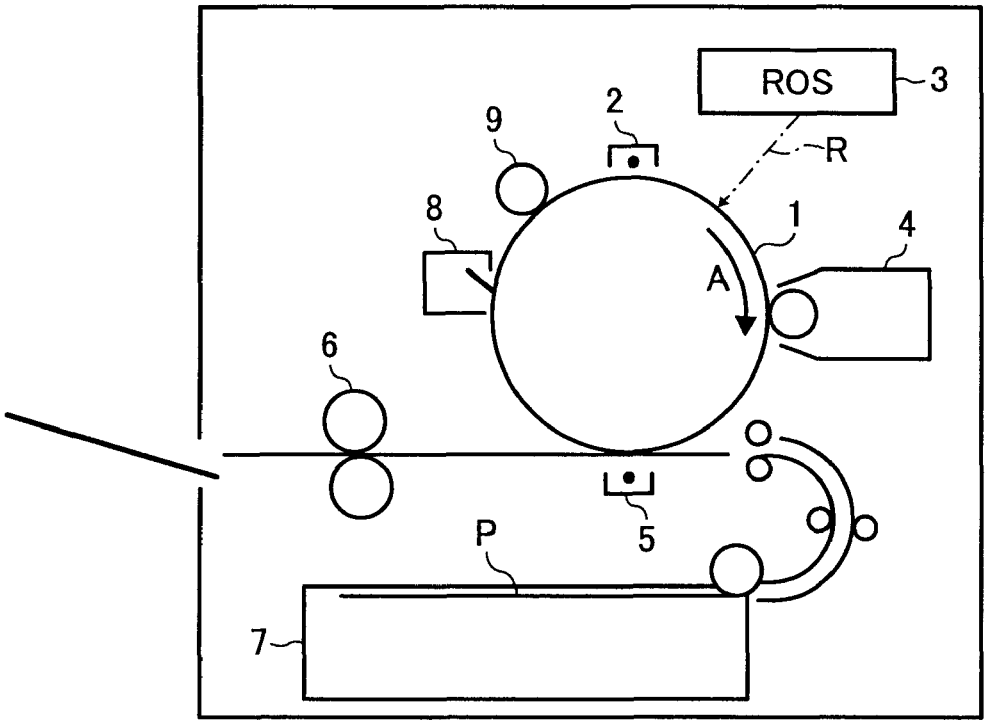
FIG. 1 is a diagram showing a simplified constitution of an image forming apparatus, which is an embodiment of the present invention.

FIG. 1 shows a simplified constitution of an image forming apparatus of this embodiment. This image forming apparatus comprises a drum-shaped photoconductive member 1 as an image carrier that rotates in the direction of arrow A. Surrounding the photoconductive member 1, the image forming apparatus comprises a Scorotron charging device 2, which charges the surface of the photoconductive member 1; an ROS (laser output portion) 3, which exposes the charged surface of the photoconductive member 1 with exposure light R, which is modulated by image information, and forms an electrostatic latent image on the photoconductive member 1; a developing device 4, which develops the electrostatic latent image on the photoconductive member 1 with toner to form a toner image on the photoconductive member 1; a transfer device 5, which transfers the toner image on the photoconductive member 1 to a sheet of paper P used as a recording medium; a cleaner 8 for cleaning the surface of the photoconductive member 1; and a neutralization device 9 for removing a residual charge from the surface of the photoconductive member 1. The image forming apparatus also comprises a fixing device 6, which fixes the toner image transferred to the paper P, and a paper tray 7, which holds the paper P.

Next, an image forming operation of the above-mentioned image forming apparatus will be explained.

First, an original image signal read in from a manuscript by an image reading portion (not shown in the figure), or an original image signal created by an external computer or the like (not shown in the figure) is inputted to an image processing portion (not shown in the figure), and appropriate image processing is carried out. An input image signal produced like this is inputted to the ROS (laser output portion) 3, and modulates the laser light R. The laser light R, which has been modulated by the input image signal, is rastered onto the surface of the photoconductive member 1, which has been uniformly charged by the Scorotron charging device 2. When the laser light R is rastered onto the surface of the photoconductive member 1, an electrostatic latent image corresponding to the input image signal is formed on the photoconductive member 1. The electrostatic latent image formed on the photoconductive member 1 is developed with toner by a developing device 4, forming a toner image on the photoconductive member 1. The toner image formed on the photoconductive member 1 is conveyed in line with the rotation of the photoconductive member 1 in the direction of arrow A toward a transfer device 5, which is arranged facing the photoconductive member 1.

Meanwhile, a sheet of paper P, which is stored in the paper tray 7, is supplied toward the nip portion between the photoconductive member 1 and the transfer device 5, and the toner image on the photoconductive member 1 is transferred onto the paper P by the transfer device 5. The toner image, which has been transferred onto the paper P, is conveyed and fixed by the fixing device 6 to produce the desired image. Residual toner and other such deposits, which adhere to the surface of the photoconductive member 1 following the transfer of the toner image to the paper P, is cleaned by the cleaner 8, and in addition, the residual charge of the surface of the photoconductive member 1 is removed by the neutralization device 9, and one image forming operation ends.

Next, the fixing device 6 related to this embodiment will be explained.

Figure 2:
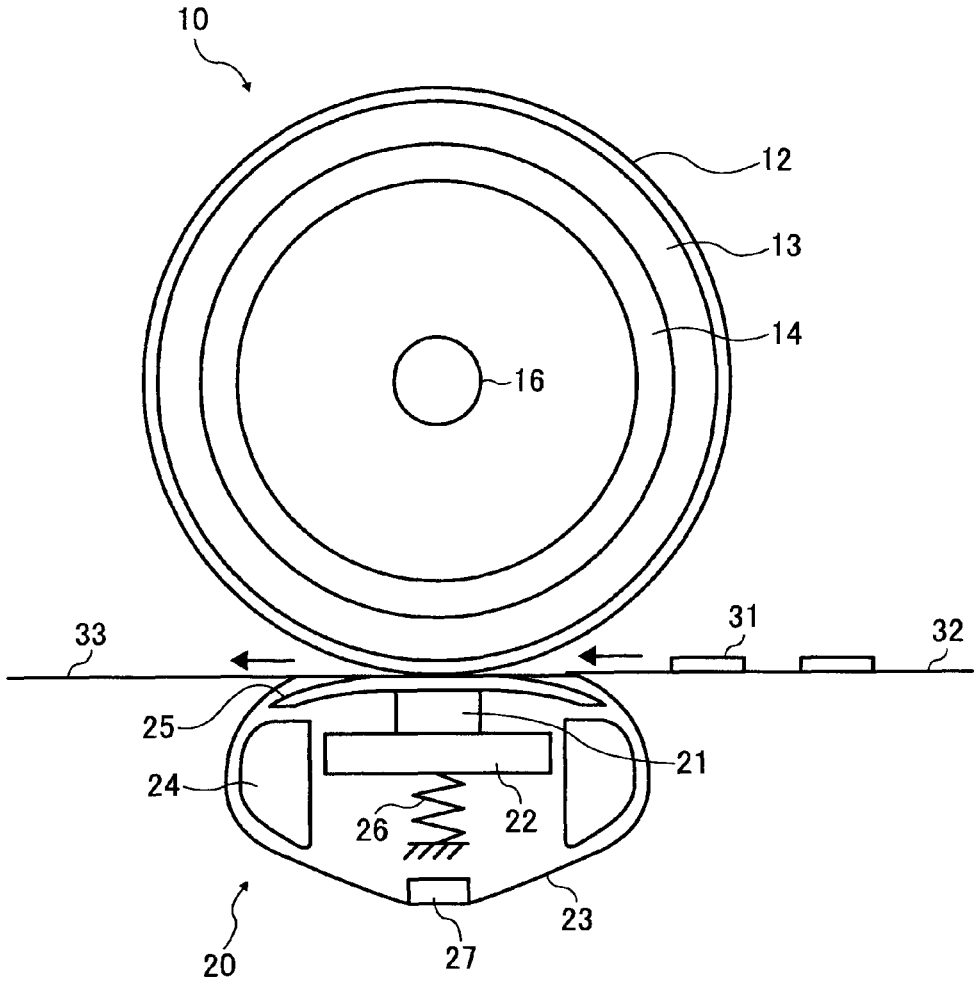
FIG. 2 is a diagram showing a simplified constitution of a fixing device, which is employed in this image forming apparatus.

FIG. 2 shows a simplified constitution of the fixing device 6 employed in the above-mentioned image forming apparatus. This fixing device 6 comprises a heat-fixing roller 10 as heating means; and pressurizing means 20, which has an endless member 23 for conveying in the direction of the arrow shown in the figure, while applying pressure such that a recording medium 32, which carries unfixed toner 31 on its surface, comes in contact with the heat-fixing roller 10. The heat-fixing roller 10 has a surface cover layer 12; an elastic layer 13 as an elastic member; a mandrel 14; and a heat source 16, and is constituted so as to be rotatable by driving means not shown in the figure. A PFA layer or the like can be used as the surface cover layer 12 of the heat-fixing roller 10 so that unfixed toner 31 is not apt to adhere to the heat-fixing roller 10. Further, silicone rubber or fluorine rubber is generally used as the elastic layer 13. When silicone rubber is used, a fluorine layer can be applied as a coating for enhancing swelling resistance.

Pressurizing means 20 comprises a pressure member, which is made from a slavable endless member 23 for conveying a recording medium, a pressurized elastic member 21 as an elastic member, a support member 22 for supporting the pressurized elastic member 21, and a pressure cylinder 26 as biasing means for pressure biasing the pressurized elastic member 21 supported by the support member 22 toward the recording medium 32; a low friction member 25 for reducing the friction between the endless member 23 and the pressurized elastic member 21; and a guide 24, which controls the conveyance route of the endless member 23. Further, pressurizing means 20 also comprises a lubricant supplying member 27 for supplying lubricant for further reducing the friction between the endless member 23 and the pressurized elastic member 21. Generally speaking, the lubricant used is one comprising either silicone oil or fluorine oil. The endless member 23 is formed from PFA and polyimide. The surface of the pressurized elastic member 21 in the direction of pressurization utilizes a flat pressure pad, and has a rubber layer of either silicone rubber or fluorine rubber.

In a fixing device 6 like this, a fixed image 33 is formed on the recording medium 32 by passing the recording medium 32, which is carrying an unfixed toner image 31, through a nip portion formed between the heat-fixing roller 10 and the endless member 23 of pressurizing means 20. Here, pre-cut paper or other such paper is used as the recording medium 32.

Next, the pressurized elastic member 21 of the pressure member will be explained in detail.

Figure 3:
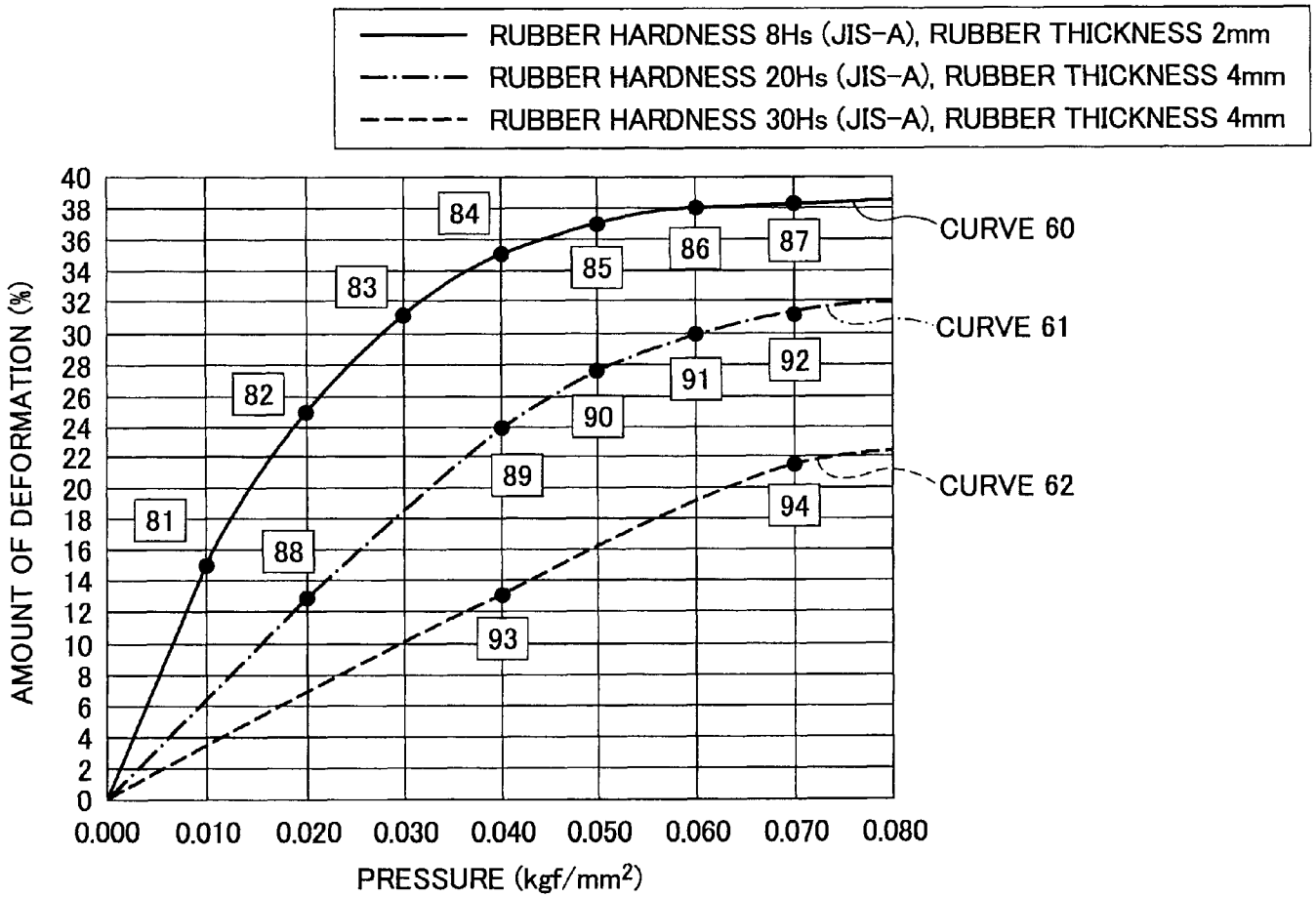
FIG. 3 is a graph showing the physical property values of the rubber of a pressurized elastic member.

FIG. 3 is a graph showing the results of changing the hardness and thickness of the rubber in the load direction of the pressure pad utilized as the pressurized elastic member 21, and measuring the amount of deformation of the rubber in the load direction relative to a pressure value. In FIG. 3, curve 60 is the deformation curve of a rubber hardness of 8 Hs (JIS-A) and a rubber thickness of 2 mm in the load direction, curve 61 is the deformation curve of a rubber hardness of 20 Hs (JIS-A) and a rubber thickness of 4 mm in the load direction, and curve 62 is the deformation curve of a rubber hardness of 30 Hs (JIS-A) and a rubber thickness of 4 mm in the load direction.

In curve 60, point 81 represents an amount of deformation in the vicinity of a pressure value of 0.010 kgf/mm$^2$, point 82 represents an amount of deformation in the vicinity of a pressure value of 0.020 kgf/mm$^2$, point 83 represents an amount of deformation in the vicinity of a pressure value of 0.030 kgf/mm$^2$, point 84 represents an amount of deformation in the vicinity of a pressure value of 0.040 kgf/mm$^2$, point 85 represents an amount of deformation in the vicinity of a pressure value of 0.050 kgf/mm$^2$, point 86 represents an amount of deformation in the vicinity of a pressure value of 0.060 kgf/mm$^2$, and point 87 represents an amount of deformation in the vicinity of a pressure value of 0.070 kgf/mm$^2$. Thus, it is clear from curve 60 that the amount of deformation steadily saturates as shown by the values at points 81 through 87.

In curve 61, point 88 represents an amount of deformation in the vicinity of a pressure value of 0.020 kgf/mm$^2$, point 89 represents an amount of deformation in the vicinity of a pressure value of 0.040 kgf/mm$^2$, point 90 represents an amount of deformation in the vicinity of a pressure value of 0.050 kgf/mm$^2$, point 91 represents an amount of deformation in the vicinity of a pressure value of 0.060 kgf/mm$^2$, and point 92 represents an amount of deformation in the vicinity of a pressure value of 0.070 kgf/mm$^2$. Curve 61 shows a linear relationship between amount of deformation and pressure in low pressure regions (from 0 to 0.030 kgf/mm$^2$), and a tendency for the amount of deformation to saturate can begin to be seen in the high pressure regions (0.070 kgf/mm$^2$ and higher).

In curve 62, point 93 represents an amount of deformation in the vicinity of a pressure value of 0.040 kgf/mm$^2$, and point 94 represents an amount of deformation in the vicinity of a pressure value of 0.070 kgf/mm$^2$. Thus, it is clear from curve 62 that, unlike curves 60 and 61, the relationship between the amount of deformation and pressure maintains linearity up to the high pressure regions.

FIG. 4 brings together amount of deformation (%), pressure (kgf/mm$^2$), amount of deformation in the load direction (%/(kgf/mm$^2$)), and the rate of change of the deformation ratio in the load direction in the low pressure regions (compared to initial amount of deformation) (%) for the respective elastic members 21 as shown FIG. 3. Furthermore, in curve 60, the initial amount of deformation is given as the pressure value in the vicinity of 0.010 kgf/mm$^2$ of point 81. Further, in curve 61, the initial amount of deformation is given as the pressure value in the vicinity of 0.020 kgf/mm$^2$ of point 88. Further, in curve 62, the initial amount of deformation is given as the pressure value in the vicinity of 0.040 kgf/mm$^2$ of point 93. Thus, although the pressure values, which are the references, differ, since the deformation ratios in curves 61 and 62 are linear from this point in the low pressure regions, the rate of change can be thought of as constituting the same numerical value in the pressure value reference regions 0 through 0.010 kgf/mm$^2$.

Figure 5:
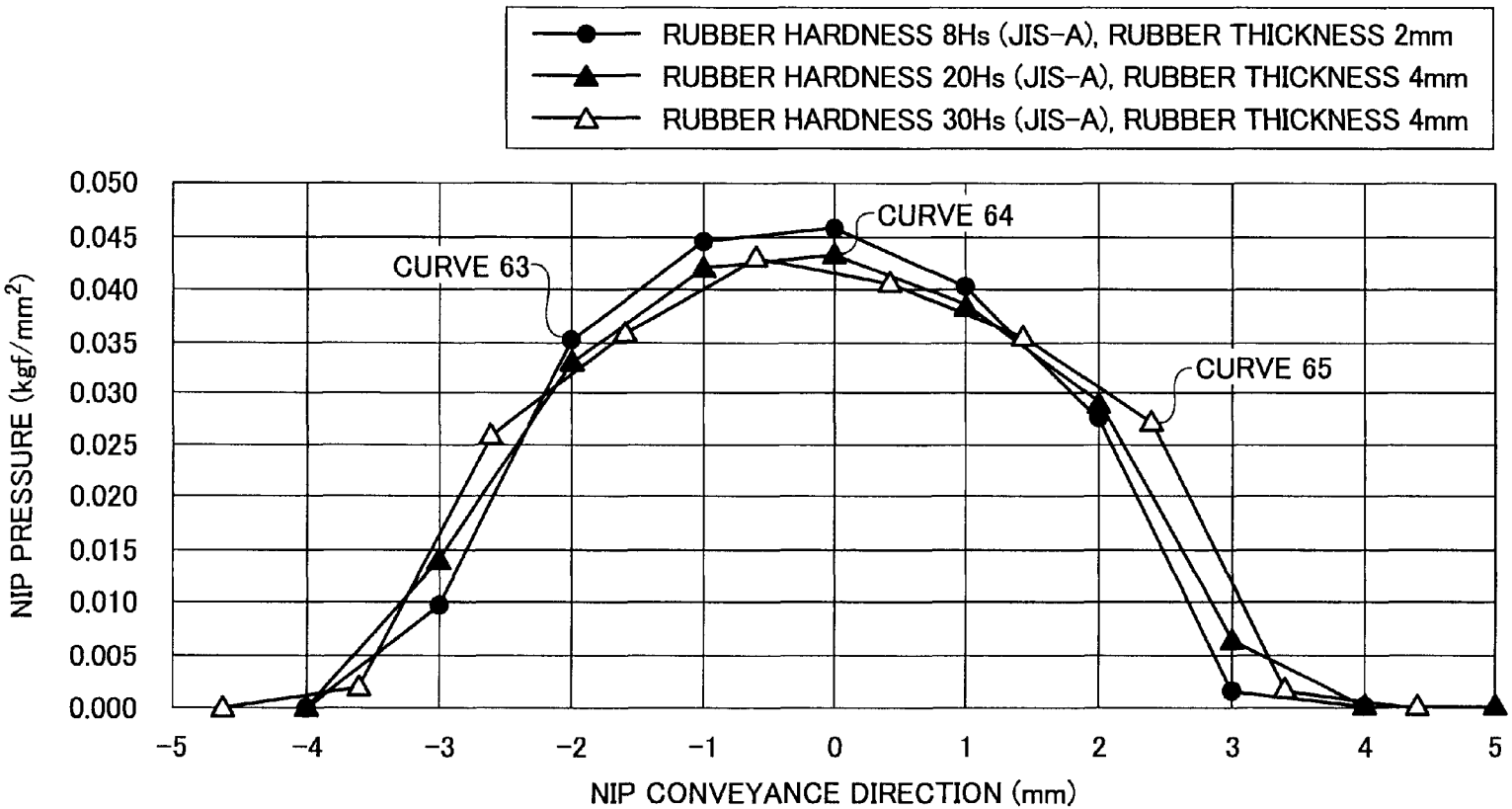
FIG. 5 is a graph showing the results of measurements of the pressure distribution of a heat-fixing roller.

Further, FIG. 5 shows the results of applying a load of 40 kgf to the heat-fixing roller 10 in the fixing device 6 shown in FIG. 2, bringing it into contact with the various pressurized elastic members 21, and taking actual measurements of the pressure distribution in the nip portion. The heat-fixing roller 10 used was made by Showa Electric Wire and Cable Co., Ltd., had an outside diameter of 27 mm, an elastic layer rubber thickness of 1.0 mm, an elastic layer rubber hardness of 8 Hs (JIS-A), and an elastic layer permanent deformation of 4%.

In FIG. 5, curve 63 represents the nip portion pressure distribution when a Showa Electric and Cable Co., Ltd. rubber pad with rubber hardness of 8 Hs (JIS-A), rubber permanent deformation of 4%, a rubber thickness in the load direction of 2 mm, rubber width in the conveyance direction 4 mm, and rubber length in the axial direction of 230 mm was used as the pressurized elastic member 21. Curve 64 represents the nip portion pressure distribution when a Showa Electric and Cable Co., Ltd. rubber pad with rubber hardness of 20 Hs (JIS-A), rubber permanent deformation of 4%, a rubber thickness in the load direction of 4 mm, rubber width in the conveyance direction of 6 mm, and rubber length in the axial direction of 230 mm was used as the pressurized elastic member 21. Curve 65 represents the nip portion pressure distribution when a Showa Electric and Cable Co., Ltd. rubber pad with rubber hardness of 30 Hs (JIS-A), rubber permanent deformation of 4%, a rubber thickness in the load direction of 4 mm, rubber width in the conveyance direction of 6 mm, rubber width in the conveyance direction of 7.5 mm, and rubber length in the axial direction of 230 mm was used as the pressurized elastic member 21. The nip width was adjusted to coincide with a width of between 7 mm and 8 mm for the respective rubber widths in the conveyance direction.

The reason for adjusting the nip width between 7 mm and 8 mm here is because the time required for completely fixing toner onto a sheet of paper can be gained with a 7 mm to 8 mm nip width. This nip width is proportional to the printing speed of the image forming apparatus, and is adjusted as needed in accordance with the printing speed. It is clear from FIG. 5 that the maximum pressure value and gradient of pressure at the nip edge are greater in curve 63 than they are in curve 65.

Further, when the rubber permanent deformation of the elastic layer 13 of the heat-fixing roller 10 is large, the surface shape of the heat-fixing roller 10 deforms locally, becoming the cause of image deterioration, such as uneven image brightness. Experimentation revealed that uneven brightness was notable when the rubber permanent deformation of the elastic layer 13 of the heat-fixing roller 10 was 5% or larger, making a rubber permanent deformation of no more than 4% desirable. Further, when the rubber permanent deformation of the pressurized elastic member 21 is large, the shape of the nip will deform over time, and can result in unstable fixing and separating characteristics. FIG. 6 shows the results of studies conducted on initial and over-time images, fixing characteristics, and separating characteristics, by changing the rubber permanent deformation of the pressurized elastic member 21.

As shown in FIG. 6, it was possible to ascertain that image quality, fixing characteristics, and separating characteristics dropped after 100 hours or more of idle heating when the rubber permanent deformation of the pressurized elastic member 21 was 5% or larger. Accordingly, it is clear that the rubber permanent deformation of the pressurized elastic member 21 should preferably be no more than 4%.

Figure 7:
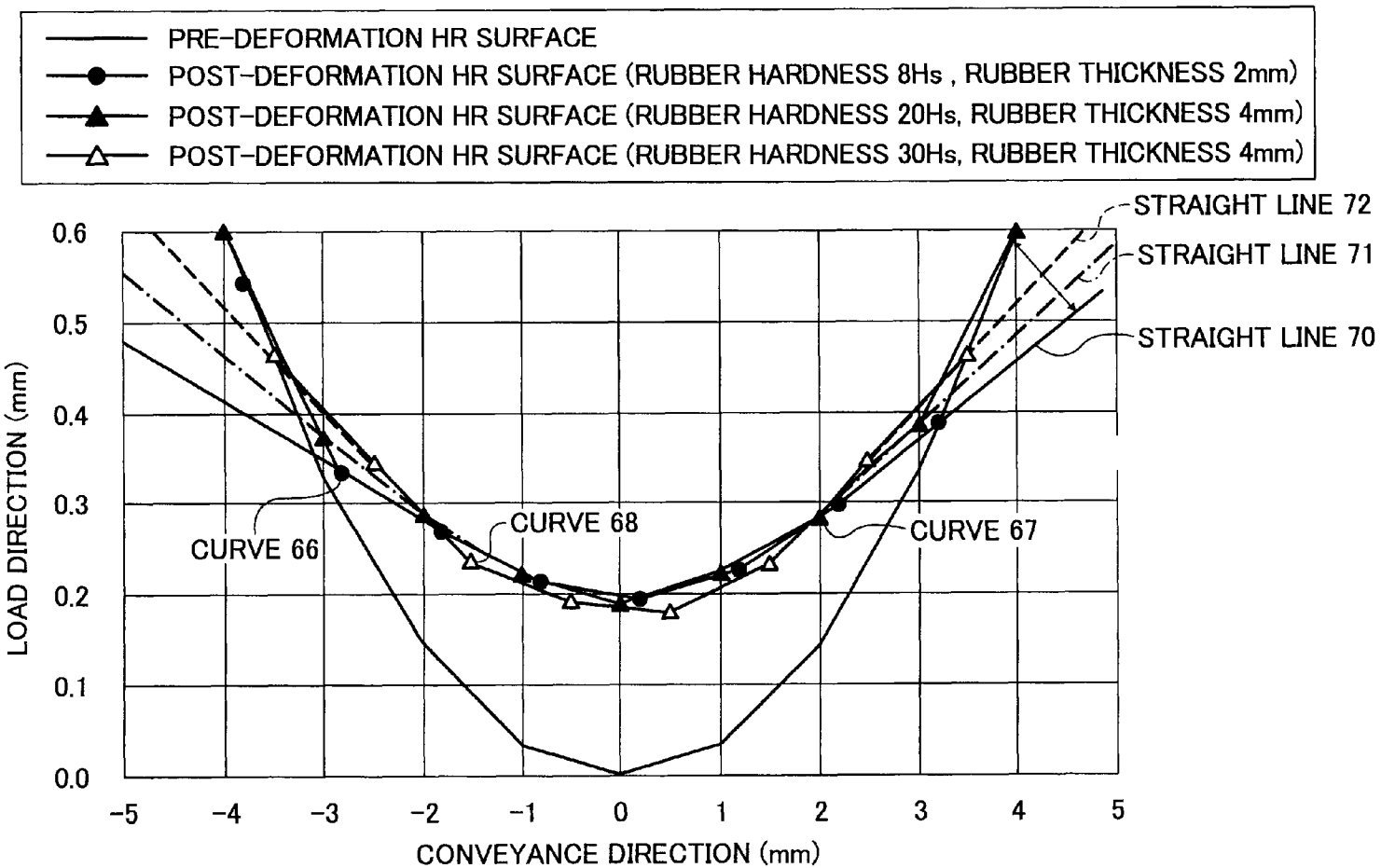
FIG. 7 is a graph showing the shape of the nip portion of the heat-fixing roller and orientation of the paper protruding from the outlet portion.

Based on the measurement results of rubber characteristic values of FIG. 4, FIG. 7 shows the results of computations of deformation shapes of the elastic layer 13 of the heat-fixing roller 10 based on measured pressure distributions. Furthermore, although these computation results do not take into account deformations in the conveyance direction or axial direction of the rubber, they are considered adequate computations for a comparison study.

In FIG. 7, curve 69 represents a surface shape when the elastic layer 13 of the heat-fixing roller 10 forms a nip portion that aligns with the curvature. Curve 66 represents the surface shape of the elastic layer 13 of the heat-fixing roller 10 subsequent to nipping and deforming a pressurized elastic member 21 with a rubber hardness of 8 Hs (JIS-A) and a rubber thickness in the load direction of 2 mm. Curve 67 represents the surface shape of the elastic layer 13 of the heat-fixing roller 10 subsequent to nipping and deforming a pressurized elastic member 21 with a rubber hardness of 20 Hs (JIS-A) and a rubber thickness in the load direction of 4 mm. Curve 68 represents the surface shape of the elastic layer 13 of the heat-fixing roller 10 subsequent to nipping and deforming a pressurized elastic member 21 with a rubber hardness of 30 Hs (JIS-A) and a rubber thickness in the load direction of 4 mm.

In FIG. 7, the center part of the nip of curve 66, which has rubber hardness of 8 Hs (JIS-A) and rubber thickness in the load direction of 2 mm, is the highest on the graph, and the end parts of this nip are the lowest. That is, of these three curves, clearly curve 66, with rubber hardness of 8 Hs (JIS-A) and rubber thickness in the load direction of 2 mm, has the greatest curvature, in other words, the curvature of the nip becomes smaller.

Furthermore, in FIG. 7, straight line 70 is a straight line that simulates the orientation of a recording medium 32, which has been discharged from the nip shape indicated by curve 66, straight line 71 is a straight line that simulates the orientation of a recording medium 32, which has been discharged from the nip shape indicated by curve 67, and straight line 72 is a straight line that simulates the orientation of a recording medium 32, which has been discharged from the nip shape indicated by curve 68. As shown in FIG. 7, since the curvature of curve 66 is larger than that of curve 68, straight line 70 clearly has more clearance with the surface of the heat-fixing roller 10 subsequent to the nip outlet (intersection of curve 69 and straight lines 70 through 72) than straight line 72 (equivalent to the arrows in the figure). Since straight line 70 simulates the post-nip outlet orientation of a sheet of paper, the more a recording medium part that has been discharged from the nip outlet constitutes an orientation, which faces in the direction that is as far away from the heat-fixing roller 10 as possible, the separation force between the front surface of the recording medium 32 and the surface of the heat-fixing roller 10 increases in accordance with the resilience of the recording medium 32. That is, when the clearance between the surface of the heat-fixing roller 10 of subsequent to the nip outlet and the surface of the recording medium 32 is large, the recording medium 32 separates easily.

FIG. 8 shows the results of an experiment conducted to study actual separation performance in the fixing device of FIG. 1. In this experiment, separation tests were carried out by fixing the nip width at between 7 mm and 8 mm under the same conditions as those shown in FIG. 5 described hereinabove, and changing only the constitution of the pressurized elastic member 21. Further, the recording medium 32 used was ordinary pre-cut paper having a basis weight of 55 g/cm$^2$ with a full-color image attached.

These results confirmed that separation performance improves in a fixing device 6, which utilizes a pressurized elastic member 21 with a rubber hardness of 8 Hs (JIS-A) and a rubber thickness of 2 mm in the load direction. Adequate separation performance could not be achieved in cases that utilized pressurized elastic members of the other two types. This can be seen as confirmation that the deformation shape of the elastic layer 13 of the heat-fixing roller 10 is optimized, and separation performance is improved when the pressurized elastic member 21 has a rubber hardness of 8 Hs (JIS-A) and a rubber thickness of 2 mm in the load direction, as indicated by the respective straight lines (lines that simulate the orientation of the paper) of the above-described FIG. 7.

Further, with regard to the rubber width in the conveyance direction of a pressurized elastic member 21, as described hereinabove, separating characteristics can be improved by using the pressurized elastic member 21, the width of the rubber in the conveyance direction of which is smaller than the maximum nip width. Here, maximum nip width is the nip width formed using an infinite flat plate, and is the maximum nip width of a constitution (subsequent to setting the rubber hardness, rubber thickness, and load). That is, it is the nip width that can be formed when the width of the pressurized elastic member 21 in the conveyance direction is infinitely large. Using a pressurized elastic member 21 that is smaller than the maximum nip width has an effect whereby the end of the pressurized elastic member 21 in the conveyance direction bites into the elastic layer 13 of the heat-fixing roller 10, enabling separation performance to be enhanced.

Furthermore, upon detailed examination using FIG. 8, it was learned that when a pressurized elastic member 21 with a rubber hardness of 8 Hs and a rubber thickness in the load direction of 2 mm is used, the nip region, which is constituted at not less than a pressure value (approximately 0.025 kgf/mm$^2$) for which the rate of change of the rubber deformation ratio (refer to FIG. 4) is not more than −30% (1500−>1050%/(kgf/mm$^2$)), is 5.0 mm, and accounts for 63% of the entire nip region. The curvature of the deformation shape of the elastic layer 13 of the heat-fixing roller 10 is sufficiently large, and can efficiently enhance separation performance only when this region is 50% or larger. By comparison, it was learned that when a pressurized elastic member 21 with a rubber hardness of 20 Hs and a rubber thickness in the load direction of 4 mm is used, the nip region, which is constituted at not less than a pressure value (approximately 0.042 kgf/mm$^2$) for which the rate of change of the rubber deformation ratio (refer to FIG. 4) is not more than −30% (650−>455%/(kgf/mm$^2$)), is 1.0 mm, and accounts for 13% of the entire nip region.

Furthermore, it was learned that when a pressurized elastic member 21 with a rubber hardness of 30 Hs and a rubber thickness in the load direction of 4 mm is used, there is no nip region constituted at not less than a pressure value for which the rate of change of the rubber deformation ratio (refer to FIG. 4) is not more than −30%. Thus, when the pressurized elastic member 21 has a rubber hardness of 30 Hs and a thickness of 4 mm, the curvature of the deformation shape of the heat-fixing roller 10 elastic layer 13 is small, making it impossible to achieve adequate separation performance.

Further, as shown in the pressure distribution diagram of the nip portion of the heat-fixing roller 10 of FIG. 5, curve 63 clearly has a sharper slope distribution than curves 64 and 65. In the central region of the pressure distribution of curve 63 in FIG. 5, the amount of rubber deformation approaches the saturation region (limits of deformation region), thereby greatly reducing the rubber elastic portion, which gives rise to a phenomenon whereby the hardness becomes harder, and generates the local deformation of the elastic layer 13 of the heat-fixing roller 10 within this region, making it possible to optimize the orientation of the paper protruding from the nip outlet portion.

Furthermore, based on the idea that paper separates easily when the clearance between the surface of the heat-fixing roller 10 subsequent to the nip outlet and the surface of the paper is great, it is clear that the outside diameter of the heat-fixing roller 10 is another parameter for determining this clearance. Accordingly, the inventors carried out an experiment to study separating characteristics by changing the respective characteristics of the heat-fixing roller 10 as follows. The results are given in FIG. 9.

According to the results of the experiment shown in FIG. 9, it was possible to ascertain that separation performance drops when the outside diameter of the heat-fixing roller 10 is larger than 27 mm. Accordingly, it is desirable that the outside diameter of the heat-fixing roller 10 be not more than 27 mm. Further, it was also learned that the thickness of the elastic layer 13 of the heat-fixing roller 10 is one of the parameters for determining the clearance between the surface of the heat-fixing roller 10 and the surface of a sheet of paper.

This experiment revealed that separation performance drops when the thickness of the rubber is smaller than 0.8 mm. This is because the amount of deformation diminishes as the thickness of the elastic layer 13 of the heat-fixing roller 10 gets thinner, making it impossible to optimize the orientation of the paper protruding from the nip outlet portion. Accordingly, it is desirable that the thickness of the elastic layer 13 of the heat-fixing roller 10 be not less than 0.8 mm. Further, it was also learned that the hardness of the rubber of the elastic layer 13 of the heat-fixing roller 10 is one more parameter for determining clearance.

This experiment revealed that separation performance drops when the hardness of the rubber is greater than 8 Hs (JIS-A). This is because the amount of deformation decreases as the hardness of the elastic layer 13 of the heat-fixing roller 10 increases, making it impossible to optimize the orientation of the paper protruding from the nip outlet portion. Accordingly, it is desirable that the hardness of the rubber of the elastic layer 13 of the heat-fixing roller 10 be not more than 8 Hs (JIS-A).

Next, another fixing device employed in the above-described image forming apparatus will be explained.

Figure 10:
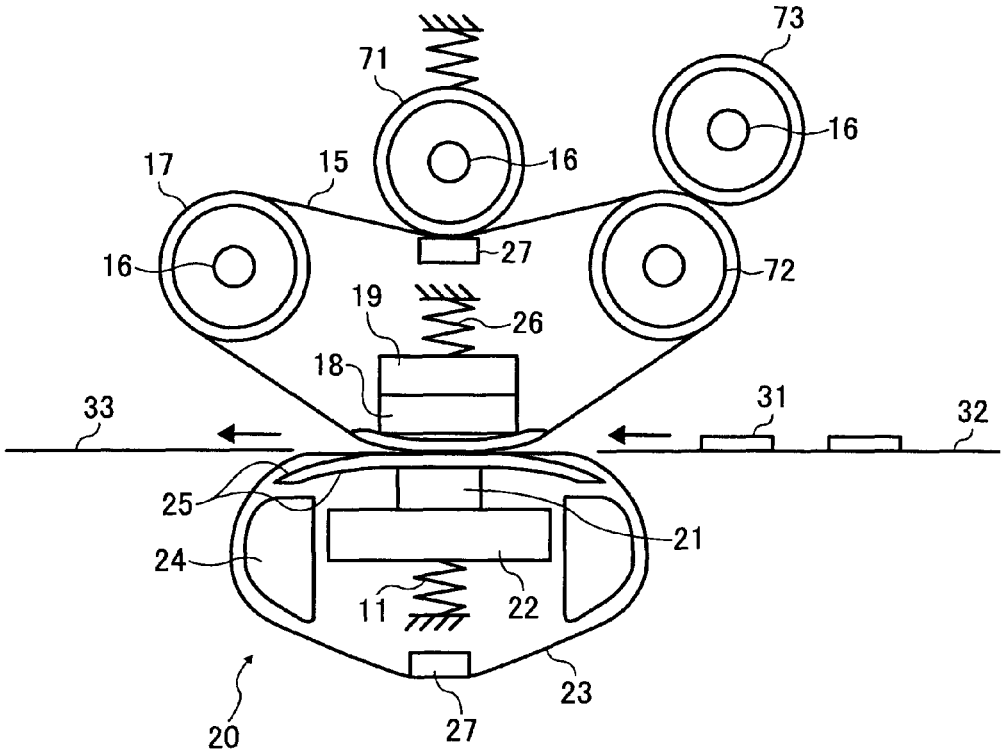
FIG. 10 is a diagram showing a simplified constitution of another example of a fixing device, which is employed in this image forming apparatus.

FIG. 10 shows a simplified constitution of this other fixing device. In this fixing device, heating means utilizes an endless heating member 15 instead of the heat-fixing roller 10, and the fixing device comprises a pressurized elastic member 18 as the elastic portion, a pressurized support member 19, which supports the pressurized elastic member 18, a heat source 16, a heating roller 17, which simultaneously tensions and heats the endless heating member 15, and a slave roller 72, which rotates while applying tension to the endless heating member 15 without having an internal heat source. It is desirable for the pressurized elastic member 18 to comprise a low-friction layer for reducing surface friction with the endless heating member 15. Further, when the quantity of heat is insufficient, there is also a method for heating the endless heating member 15 from the outside by bringing it in contact with heating rollers 71 and 73. Heating roller 17 is the drive source for driving the endless heating member 15, but this drive source can be provided in the slave roller 72. Furthermore, the constitution of pressurizing means, which is not mentioned here, is the same as that of the fixing device of FIG. 2. In this fixing device, heating means pressurized elastic member 18 forms, via the endless member, a surface curvature-aligned nip portion by virtue of the surface of pressurizing means 20 pushing into the flat pressurized elastic member 21. The region inside this nip portion is hardened by biasing same such that the amount of deformation of the pressurized elastic member 21 approaches the saturation region (maximum amount of deformation), causing deformation such that the curvature inside the nip region, which is formed along the surface curvature, increases.

Furthermore, this fixing device is more advantageous than a fixing device, which uses a heating roller 10 as in FIG. 2, in that the use of an endless heating member 15 makes it possible to adjust the nip width and the deformation shape of the nip outlet portion while minimizing the impact on the overall size of the device. Furthermore, the width of the pressurized elastic member 21 of pressurizing means 20 must be set equivalent to or smaller than the width of the pressurized elastic member 18 of heating means.

Further, the image forming apparatus of FIG. 1 described hereinabove is for forming a monochrome image, but the above-described fixing device can be used in an image forming apparatus for forming color images by overlaying toners of a plurality of colors. To fix a large quantity of toner, which overlays a plurality of colors, to a recording medium requires that fixing be carried out by applying sufficient heat and pressure inside the nip portion, and adequately melting and mixing the colors of the toner. For this reason, the adhesive force of the interface between the fused toner and surface of the heat-fixing roller within the nip portion is great, making separation more difficult than in a monochrome image forming apparatus. When the above-described fixing device is utilized in a color image forming apparatus like this, the effect on enhancing separation performance is great.

In an image forming apparatus related to this embodiment, when the amount of deformation of the pressurized elastic member 21 of pressurizing means 20 inside the nip portion region approaches the saturation region (limits of deformation region), the elastic part of the rubber greatly diminishes, and the rubber hardness becomes harder. The hardening of the pressurized elastic member 21 increases the curvature of the nip region, which is formed along the curvature of the surface of the elastic layer 13 of the heat-fixing roller 10. Consequently, the size of the device is not increased, damage to the recording medium is alleviated, and image misalignment due to localized elastic deformation of the nip region is prevented. Further, increasing the curvature of the nip region of the elastic layer 13 enhances separation performance by optimizing the orientation of a recording medium protruding from the nip outlet portion.

Further, the width of the pressurized elastic member 21 of pressurizing means 20 in the direction of recording medium conveyance is made either the same width or smaller than the nip width formed when the pressurized elastic member 21 is pressed against the elastic layer 13 of the heat-fixing roller 10 using an infinite flat plate. Consequently, the end of the pressurized elastic member 21 in the conveyance direction bites into the elastic layer 13 of the heat-fixing roller 10, making it possible to enhance separating characteristics.

Further, a nip region, which is constituted at not less than a pressure value for which the rate of change is not more than −30% compared to the deformation ratio (amount of deformation/pressure) of the pressurized elastic member 21 of pressurizing means 20 in the direction of load in a low-pressure region (0 through 0.010 kgf/mm$^2$), is made so as to account for not less than 50% of the entire nip region. Making a stipulation like this enables optimization such that the curvature of the deformation shape of the elastic layer 13 of the heat-fixing roller 10 becomes effectively larger, and efficiently enhances separation performance.

Further, the hardness of the rubber of the pressurized elastic member 21 of pressurizing means 20 is set at no more than 8 Hs (JIS-A), and the thickness thereof in the load direction is set at no more than 2 mm. Thus, optimizing the hardness and thickness in the load direction of the rubber of the pressurized elastic member 21 enables the amount of deformation of the pressurized elastic member 21 to easily approach the saturation region (limits of deformation region) without increasing pressure too much.

Further, the permanent deformation of the pressurized elastic member 21 of pressurizing means 20 is set at no more than 4%. When the permanent deformation of the rubber of the pressurized elastic member 21 is large, deformation of the nip shape can occur over time, resulting in unstable fixing and separating characteristics. It was possible to confirm that separating characteristics decline over time when the permanent deformation of the rubber is 5% or more.

Further, when heating means uses a rotatable heat-fixing roller 10 having a heat source 16 on the inside of the elastic layer 13, the above-described fixing device can be realized at low cost.

Further, the outside diameter of the heat-fixing roller 10 is set at no more than 27 mm, the hardness of the rubber of the elastic layer 13 is set at no more than 8 Hs (JIS-A), and the rubber thickness is set at no less than 0.8 mm. It was ascertained that separation performance diminishes in accordance with curvature when the outside diameter is larger than 27 mm. It was also ascertained that the amount of deformation decreases as the hardness of the elastic layer 13 increases, making it impossible to optimize the orientation of the paper protruding from the nip outlet portion when this hardness is greater than 8 Hs (JIS-A), resulting in a drop in separation performance. Further, it was ascertained that the amount of deformation decreases as the thickness of the elastic layer 13 becomes thinner, making it impossible to optimize the orientation of the paper protruding from the nip outlet portion when the thickness of the rubber is smaller than 0.8 mm, resulting in a drop in separation performance.

Further, the permanent deformation of the elastic layer 13 of the heat-fixing roller 10 is no more than 4%. This was confirmed by the fact that separation characteristics diminished after more than 100 hours of idle heating when the permanent deformation of the rubber of the pressurized elastic member 21 was not less than 5%.

Further, heating means has an elastic layer 18, a heat source 16, an endless heating member 15, and a plurality of rotatable rollers 17, 72, which apply tension to the endless heating member 15. Since an endless heating member 15 is used as heating means like this, it is advantageous in that it is possible to adjust the nip width and the deformation shape of the nip outlet portion while minimizing the impact on the overall size of the device more than when a heat-fixing roller 1 is used.

Further, the above-described fixing device can be used in an image forming apparatus, which comprises a fixing device that forms a toner image of a plurality of colors on a photoconductive member, transfers this image to an intermediate transfer member, transfers the toner image on the intermediate transfer member to a recording medium, and fixes the transferred toner onto the recording medium. In an image forming apparatus, which forms a color image by overlaying toners of a plurality of colors, fixing is carried out by applying sufficient heat and pressure on the inside of the nip portion, and adequately melting and mixing the colors of the toner, so that the adhesive force at the interface between the fused toner and surface of the heat-fixing roller within the nip portion is great, making separation more difficult than in a monochrome image forming apparatus. When the above-described fixing device is utilized in a color image forming apparatus such as this, the effect on enhancing separation performance is great.

The present invention described hereinabove has an outstanding effect that makes it possible to achieve good recording medium separation performance without increasing the size of the device, and to prevent image misalignment and achieve high-quality images without placing a major burden on a recording medium, in a low-heat-loss belt nip-type fixing device.

Various modifications will become possible for those skilled in the art after receiving the teachings of the present disclosure without departing from the scope thereof.

What is claimed is:

1. A fixing device comprising:

a heating unit including an elastic portion and a heat source; and a pressurizing unit comprising a rotatable endless member that conveys a recording medium and a pressurizing member which presses the endless member against the elastic portion of the heating unit, an unfixed toner image being fixed to a recording medium by passing the recording medium, which carries an unfixed toner image, through a nip portion formed between the elastic portion of the heating unit and the endless member of the pressurizing unit, the pressurizing member of said pressurizing unit comprising an elastic member with a flat surface, and a biasing member that biases the elastic member toward a side of the elastic member that faces the recording medium, and, in use of the biasing member, biasing being performed such that an amount of deformation of the elastic member approaches a saturation region inside a region of said nip portion, the saturation region being defined by a maximum amount of deformation of the elastic member, wherein a nip region, which is constituted by not less than a pressure value at which the rate of change is not more than −30% compared with a deformation ratio in a load direction (%/(kgf/mm$^2$) of the elastic member of said pressurizing unit in a low pressure region (0 to 0.010 kgf/mm$^2$), accounts for not less than 50% of the entire nip region.

2. The fixing device as claimed in claim 1, wherein a hardness of rubber of the elastic member of said pressurizing unit is not more than 8 Hs (JIS-A), and a thickness of same in the load direction is not more than 2 mm.

3. The fixing device as claimed in claim 1, wherein a permanent deformation of the elastic member of said pressurizing unit is not more than 4%.

4. The fixing device as claimed in claim 1, wherein said heating unit comprises a rotatable heat-fixing roller having said heat source inside said elastic portion.

5. The fixing device as claimed in claim 4, wherein an outside diameter of said heat-fixing roller is not more than 27 mm, a hardness of the rubber of the elastic portion of the heat-fixing roller is not more than 8 Hs (JIS-A), and a rubber thickness of same is not less than 0.8 mm.

6. The fixing device as claimed in claim 4, wherein a permanent deformation of the elastic portion of said heat-fixing roller is not more than 4%.

7. The fixing device as claimed in claim 1, wherein said heating unit comprises said elastic portion, said heat source, an endless heating member, and a plurality of rotatable rollers that tightly stretch the endless heating member.

8. An image forming apparatus comprising:

a fixing device that fixes toner, the fixing device comprising:

a heating unit including an elastic portion and a heat source; and a pressurizing unit comprising a rotatable endless member that conveys a recording medium and a pressurizing member which presses the endless member against the elastic portion of the heating unit, an unfixed toner image being fixed to a recording medium by passing the recording medium, which carries an unfixed toner image, through a nip portion formed between the elastic portion of the heating unit and the endless member of the pressurizing unit, the pressurizing member of said pressurizing unit comprising an elastic member with a flat surface, and a biasing member that biases the elastic member toward a side of the elastic member that faces the recording medium, and, in use of the biasing member, biasing being performed such that an amount of deformation of the elastic member approaches a saturation region inside a region of said nip portion, the saturation region being defined by a maximum amount of deformation of the elastic member, wherein a nip region, which is constituted by not less than a pressure value at which the rate of change is not more than −30% compared with a deformation ratio in a load direction (%/(kgf/mm$^2$) of the elastic member of said pressurizing unit in a low pressure region (0 to 0.010 kgf/mm$^2$), accounts for not less than 50% of the entire nip region.

9. The image forming apparatus as claimed in claim 8, wherein a hardness of rubber of the elastic member of said pressurizing unit is not more than 8 Hs (JIS-A), and a thickness of same in the load direction is not more than 2 mm.

10. The image forming apparatus as claimed in claim 8, wherein a permanent deformation of the elastic member of said pressurizing unit is not more than 4%.

11. The image forming apparatus as claimed in claim 8, wherein said heating unit comprises a rotatable heat-fixing roller having said heat source inside said elastic portion.

12. The image forming apparatus as claimed in claim 11, wherein an outside diameter of said heat-fixing roller is not more than 27 mm, a hardness of the rubber of the elastic portion of the heat-fixing roller is not more than 8 Hs (JIS-A), and a rubber thickness of same is not less than 0.8 mm.

13. The image forming apparatus as claimed in claim 11, wherein a permanent deformation of the elastic portion of said heat-fixing roller is not more than 4%.

14. An image forming apparatus comprising:

a fixing device that fixes toner, the fixing device comprising:

a fixing roller including an elastic portion;

a heat source that heats the fixing roller;

a rotatable endless member that faces the fixing roller;

a pressurizing member that includes an elastic member with a flat surface and that presses the rotatable endless member against the fixing roller, a nip portion being formed between the fixing roller and the rotatable endless member; and a biasing member that biases the pressurizing member toward a side of the fixing roller, wherein a nip region, which is constituted by not less than a pressure value at which a rate of change of a deformation ratio is not more than −30% compared with the deformation ratio on a load direction (%/(kgf/mm$^2$)) of the elastic member of said pressurizing member in a low pressure region (0 to 0.010 kgf/mm$^2$), accounts for not less than 50% of the entire nip region in a conveyance direction of a recording medium.

* * * * *